US007995931B2

(12) United States Patent
Inami et al.

(10) Patent No.: US 7,995,931 B2
(45) Date of Patent: Aug. 9, 2011

(54) IMAGE FORMING APPARATUS

(75) Inventors: Satoru Inami, Yokohama (JP); Nobuyoshi Yoshida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 209 days.

(21) Appl. No.: 12/500,302

(22) Filed: Jul. 9, 2009

(65) Prior Publication Data

US 2010/0028026 A1 Feb. 4, 2010

(30) Foreign Application Priority Data

Jul. 31, 2008 (JP) ..... 2008-198573

(51) Int. Cl.
*G03G 15/00* (2006.01)
*G03G 15/06* (2006.01)

(52) U.S. Cl. ..... 399/12; 399/55

(58) Field of Classification Search ..... 399/24, 399/25, 27, 12, 55, 111, 106, 346
See application file for complete search history.

(56) References Cited

U.S. PATENT DOCUMENTS

2003/0175040 A1 * 9/2003 Ogata et al. ..... 399/55

FOREIGN PATENT DOCUMENTS

| | | |
|---|---|---|
| JP | 6-118856 | 4/1994 |
| JP | 2001-305770 | 11/2001 |
| JP | 2004-341235 | 12/2004 |

* cited by examiner

*Primary Examiner* — Susan S Lee
(74) *Attorney, Agent, or Firm* — Fitzpatrick, Cella, Harper & Scinto

(57) ABSTRACT

A image forming apparatus includes a photosensitive drum having a high-lubricity state layer. In an initial rotation operation performed after mounting a process cartridge, in a main assembly of the image forming apparatus, a process cartridge in which lubricating particles are not applied in a contact area between a fresh cleaning blade and the photosensitive drum, toner is supplied only by application of a developing bias after the photosensitive drum and a developing sleeve are driven to supply and stagnate the toner in the contact area between the cleaning blade and the photosensitive drum.

12 Claims, 10 Drawing Sheets

(a) BEFORE UNSEALING (b) AFTER UNSEALING

IMAGE FORMING APPARATUS

FIELD OF THE INVENTION AND RELATED ART

The present invention relates to an image forming apparatus, to which a process cartridge is detachably mountable, for forming an image on a recording material (medium).

The image forming apparatus may include electrophotographic type or electrostatic recording type machines such as a copying machine, printers (a laser beam printer and an LED printer), a facsimile machine, a word processor, and a multifunction machine having functions of these machines.

The process cartridge is prepared by integrally supporting a rotatable image bearing member for bearing a latent image and image forming process means acting on the image bearing member in a cartridge which is detachably mountable to an apparatus main assembly of the image forming apparatus. Examples of the process means include a charging means for electrically charging the surface of the image bearing member, an information writing means for forming a latent image on the charged surface of the image bearing member, a developing means for developing the latent image with a developer, and a cleaning means for removing the developer from the state of the image bearing member. The process cartridge includes the image bearing member and at least one of the above-described process means which are integrally supported in a cartridge. The recording material may, e.g., be a sheet member such as a sheet of paper, an OHP sheet, a label, or fabric. The apparatus main assembly is a portion of the image forming apparatus other than the process cartridge.

In a conventional image forming apparatus using an electrophotographic image forming process, a process cartridge system has been frequently used. In this process cartridge system, a drum type electrophotographic photosensitive member as a rotatable image bearing member (hereinafter referred to as a photosensitive drum) and process means acting on the photosensitive drum are integrally supported in a cartridge, which is detachably mountable to the apparatus main assembly of the image forming apparatus.

According to the process cartridge system, maintenance of the apparatus can be performed by a user himself (herself) without relying on a service person, so that operativity. Therefore, the process cartridge system has been widely used in the electrophotographic image forming apparatus.

Incidentally, as the cleaning means for removing toner remaining on the surface of the photosensitive drum in the process cartridge, a blade cleaning system has been used in many cases. In the blade cleaning system, a cleaning blade having elasticity is used as a cleaning member and is provided in a counter direction with respect to a rotational direction of the photosensitive drum to be in contact with the photosensitive drum in a predetermined area in which a nip is formed and the surface of the rotating photosensitive drum is cleaned.

According to the blade cleaning system, a high cleaning performance can be obtained. However, when a friction resistance between the cleaning blade and the photosensitive drum is high, the cleaning blade is deformed to cause problems such as blade noise, turning-up of the blade, and breakage of the blade.

In order to solve the problems, as described in Japanese Laid-Open Patent Application (JP-A) Hei 06-118856, a lubricant of fine particles is applied, in the contact area of the cleaning blade with the surface of the photosensitive drum, as a lubrication action agent for decreasing the friction resistance between the cleaning blade and the photosensitive drum in many cases. As the lubricant of fine particles, e.g., it is possible to use toner particles, silica particles, fluorine-containing carbon particles, and the like. By applying the lubricant of fine particles, the friction resistance between the cleaning blade and the photosensitive drum can be suppressed at an initial stage of use of the process cartridge, so that it is possible to solve troubles (problems) such as the blade noise, the turning-up of the blade, and the breakage of the blade during an operation of the image forming apparatus.

Further, as described in JP-A 2004-341235, when the process cartridge is judged as a fresh cartridge, the toner is deposited on the photosensitive drum by applying a predetermined charging bias and a predetermined developing bias. As a result, the toner is stagnated at the contact portion of the cleaning blade with the photosensitive drum, thus being used as the lubrication action agent.

Further, in a method described in JP-A 2001-305770, the use of a surface layer improved in lubricity of the photosensitive drum surface is proposed. According to this method, it is possible to solve the problems of the noise, turning-up, and breakage of the cleaning blade by imparting high lubricity to the photosensitive drum surface.

Incidentally, in the method described in JP-A Hei 06-118856, a step of dispersing the lubricant of fine particles in a solvent and then applying the resultant dispersion onto the cleaning blade is required, so that it is necessary to use the solvent.

In that respect, the means described in JP-A 2001-305770 does not require the application of the lubricant of fine particles to the cleaning blade. However, in the surface layer of the photosensitive drum for improving the lubricity as described in JP-A 2001-305770, the high lubricity is obtained but in the case of applying the charging bias, the surface layer is abraded due to electric discharge attack and is increased in friction resistance by an electric discharge product. For that reason, a step of supplying the toner to the cleaning blade before the high-lubricant layer is abraded off is needed.

In the method described in JP-A 2004-341235, development with the toner is performed after the charging bias is applied. For that reason, the high-lubricant layer is abraded before the toner reaches the contact portion of the cleaning blade with the photosensitive drum, so that there is possibility of the turning-up of the cleaning blade due to the increased friction resistance.

SUMMARY OF THE INVENTION

The present invention has been accomplished in view of the above-described circumstances.

A principal object of the present invention is to provide an image forming apparatus using a process cartridge system in which a stable cleaning performance is retained throughout a lifetime of a process cartridge with no noise and turning-up of a cleaning blade.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

<General Structure of Image Forming Apparatus>

Figure 2:
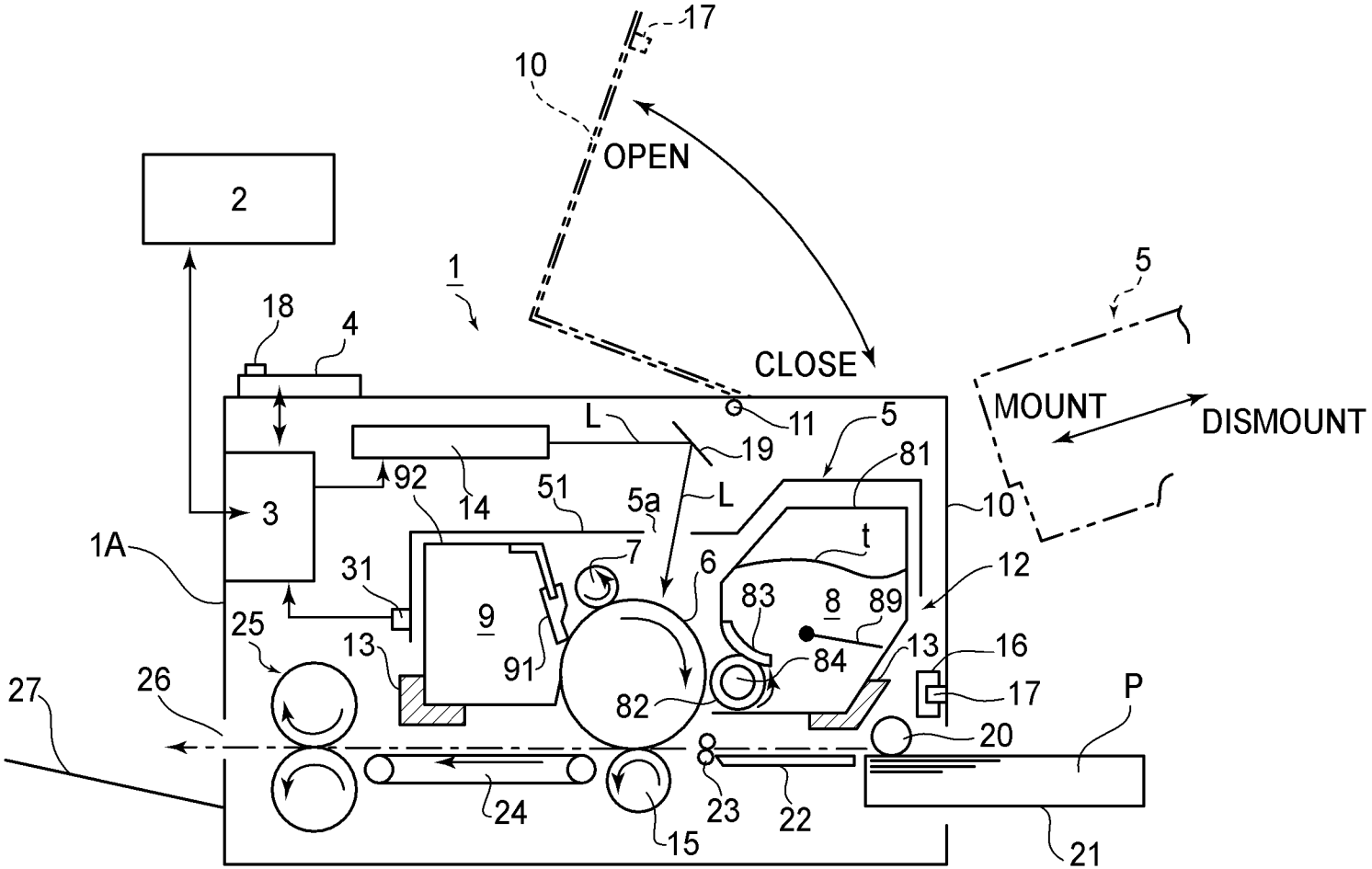
FIG. 2 is a schematic view of an image forming apparatus in Embodiment 1.

FIG. 2 is a schematic view showing an image forming apparatus A in this embodiment. The image forming apparatus 1 is a laser beam printer of a process cartridge type using an electrophotographic process. That is, the image forming apparatus 1 is connected to a host device 2 such as a personal computer or an image reader through a LAN and carries out an image forming operation on a sheet-like recording material (recording medium) P on the basis of electric image information inputted from the host device 2 to a control circuit portion (control means: CPU) 3. The control circuit portion 3 gives and receives various pieces of the electric information between the control circuit portion 3 and the host device 2 or an operating portion 4 and subjects the image forming apparatus 1 to centralized control of an image forming operation in accordance with a predetermined control program or a predetermined reference table.

In the following description, a widthwise direction of a process cartridge (cartridge) 5 refers to a direction in which the cartridge 5 is mounted to and demounted from an apparatus main assembly 1A of the image forming apparatus 1. A longitudinal direction of the cartridge 5 refers to a direction perpendicular to the direction in which the cartridge 5 is mounted to and demounted from the apparatus main assembly 1A. Further, with respect to the cartridge 5, a front surface (side) refers to a surface (side) (a right-hand surface (side) in FIG. 2) opposite from an insertion leading end-side surface (a left-hand surface (side) in FIG. 2) with respect to the apparatus main assembly 1A. A rear surface (side) refers to an opposite surface (side) from the front state (side) as seen from the front surface (side). Left and right surfaces (sides) refer to those of the cartridge 5 as seen from the front surface (side) of the cartridge 5. Further, an upper surface (side) refers to a surface (side) located at an upper portion in a state in which the cartridge 5 is mounted to the apparatus main assembly 1A and a lower surface (side) refers to a surface (side) located at a lower portion of the cartridge 5. Further, with respect to the image forming apparatus 1, a front surface (side) refers to a surface (side) where an openable door (openable cover) 10 is provided. Left and right surfaces (sides) refer to those of the image forming apparatus 1 as seen from the front surface (side) of the image forming apparatus 1.

The cartridge 5 in this embodiment is prepared as a cartridge by integrally supporting a rotatable image bearing member 6 having a surface layer containing a lubricating material, and a charging means 7, a developing means 8, and a cleaning means 9 which are electrophotographic process means acting on the image bearing member 6 and is detachably mountable to the apparatus main assembly 1A. In this embodiment, the image bearing member 6 is a rotatable drum type electrophotographic photosensitive member (hereinafter referred to as a photosensitive drum). The charging means 7 electrically charges uniformly the (peripheral) surface of the photosensitive drum 6 to a predetermined polarity and a predetermined potential and in this embodiment, a contact charging roller is used as the charging means 7. The developing means 8 develops (visualizes) an electrostatic latent image formed on the surface of the photosensitive drum 6 with a developer (visible powder, hereinafter referred to as toner) t into a toner image. The cleaning means 9 removes transfer residual toner from the photosensitive drum surface. In this embodiment, as the cleaning means (member), a blade cleaning means using a cleaning blade 91 is employed. A reference numeral 51 represents an outer casing (a cartridge frame) of the cartridge 5. The above-described photosensitive drum 6, charging means 7, developing means 8, and cleaning means 9 are assembled into the cartridge 5 in the outer casing with a predetermined positional relation.

In this embodiment, the cartridge 5 is subjected to a mounting and demounting (dismounting) operation by opening an openable door 10 of the apparatus main assembly 1A about a hinge portion 11 as indicated by a chain double-dashed line to widely expose the inside of the apparatus main assembly 1A. When the door 10 is opened, a cartridge mounting portion 12 in the apparatus main assembly 1A is in sight. At left and right wall portions of the mounting portion 12, when the mounting portion 12 is seen from an opening side on which the door 10 is opened, downward and backward guide rails (not shown) are in sight. The cartridge 5 is inserted into the mounting portion 12 along the guide rails by gripping a front portion of the cartridge 5 with hand and engaging left and right portions of the cartridge 5 with the left and right guide rails with a rear portion of the cartridge 5 forward. When the cartridge 5 is sufficiently inserted, the cartridge 5 is stopped by a positioning member 13 and is held at a predetermined mounting position, so that an exposure opening 5*a* located at an upper surface of the cartridge 5 faces a folding mirror 19 of a laser scanner unit 14 as an information writing means (an exposure device). Further, a downwardly exposed lower surface of the photosensitive drum 6 faces and contacts a transfer roller (a transfer means) 15. Then, the door 10 of the apparatus main assembly 1A is closed.

A door switch (a safety switch or an emergency stop switch) 16 is provided to the apparatus main assembly 1A. The door switch 16 is kept in an ON state by being pushed by a pusher 17 when the door 10 is closed to close a power source circuit (not shown) of the image forming apparatus 1. When the door 10 is opened, the pusher 17 is moved apart from the door switch 16, so that the door switch 16 is kept in an OFF state to open the power source circuit. That is, the door switch 16 is turned off when the door 10 of the image forming apparatus 1 is opened and is turned on when the door 10 is closed.

The cartridge 5 is mounted in the apparatus main assembly 1A in a predetermined manner and is then the door 10 is closed, so that the cartridge 5 is placed in a state in which the cartridge 5 is mechanically and electrically connected to the apparatus main assembly 1A side. That is, driven members (the drum, the developing roller, a toner stirring member, and the like) on the cartridge side are placed in a drivable state by a driving mechanism (not shown) on the apparatus main assembly 1A side. Further, various sensors (not shown) on the cartridge 5 side are placed in an electrically connected state with the control circuit portion 3 on the apparatus main assembly 1A side. Further, a predetermined bias can be applied from a bias application power source portion (not shown) on the apparatus main assembly 1A side to the charging roller, the developing roller, and the like on the apparatus main assembly 1A side.

Demounting of the cartridge 5 from the apparatus main assembly 1A is the reverse of the above-described mounting procedure. That is, in FIG. 2, when the door 10 is opened and then the cartridge 5 is pulled out upwardly and rightwardly, the cartridge 5 is guided by the above-described left and right guide rails to come out of the apparatus main assembly 1A from the mounting portion 12.

Incidentally, in this embodiment, when the cartridge 5 is demounted from the apparatus main assembly 1A, a drum shutter (not shown) is moved to a closing position in which the drum shutter covers the lower surface of the photosensitive drum 6, thus protecting the lower surface of the drum. The drum shutter is moved to an opening position in interrelation with mounting movement of the cartridge 5 to the apparatus main assembly 1A during the mounting movement. Further, during a demounting (drawing) movement of the cartridge 5 from the apparatus main assembly 1A, the drum shutter is moved to the closing positions in interrelation with the demounting movement. Further, when the cartridge 5 is demounted from the apparatus main assembly 1A, an exposure portion shutter (not shown) is moved to a closing position in which the exposure opening 5*a* is closed. The exposure portion shutter is moved to an opening position, during the mounting movement of the cartridge to the apparatus main assembly 1A, in interrelation with the mounting movement. Further, during the demounting movement of the cartridge 5 from the apparatus main assembly 1A, the exposure portion opening is moved to the closing position in interrelation with the demounting operation.

The image forming apparatus 1 is a stand-by state in which the image forming apparatus 1 is capable of performing an image forming operation under a condition in which a main (power) switch 18 of an operating portion 4 is turned on (power on) and the cartridge 5 is mounted in the apparatus main assembly 1A and in which the door switch 16 is turned on by the closing of the door 10.

In this stand-by state, when electrical image information for printing is inputted from the host device 2 into the control circuit portion 3, the control circuit portion 3 processes the inputted image information at an image processing portion (not shown) to execute an image forming process on the basis of an image formation start signal (print start signal).

That is, a driving motor (not shown) is actuated to rotationally drive the photosensitive drum 6 in a clockwise direction indicated by an arrow at a predetermined speed (process speed). The process speed of the image forming apparatus 1 in this embodiment is 150 mm/sec.

The surface of the rotatably driven photosensitive drum 6 is electrically charged uniformly to the predetermined polarity and the predetermined potential by the charging roller 7. The charging roller 7 is prepared by forming an electroconductive elastic member on the surface of a core metal and is rotatably held at both end portions of the core metal, thus being disposed in parallel to the photosensitive drum 6. Further, the charging roller 7 is disposed in contact with the surface of the photosensitive drum 6 with a predetermined pressing (urging) force and is rotated by the rotation of the photosensitive drum 6. In this embodiment, to the charging roller 7, a charging bias in the form of superimposed AC and DC voltages is applied through sliding contacts (not shown) by a charging bias applying power source (not shown). Specifically, an AC voltage of 1600 V in terms of a peak-to-peak voltage and a DC voltage of −600 V are applied. As a result, the surface of the photosensitive drum 6 is electrically charged uniformly to a potential of approximately −600 V. The charging bias to be applied to the charging roller 7 may also be only the DC voltage. Further, the charging means 7 may also be a corona charger of a non-contact charging type.

The charged surface of the photosensitive drum 6 is subjected to laser scanning exposure by the laser scanner unit 14, so that the electrostatic latent image corresponding to the image information is formed on the surface of the photosensitive drum 6. The unit 14 includes a semiconductor laser, a polygonal mirror, a correction lens (f-θ lens), and the like and outputs laser light L modulated correspondingly to time-serial electric digital pixel signal for the image information inputted from the host device 2 to the control circuit portion 3. The laser light L is reflected by the folding mirror 19 to enter the cartridge 5 from the exposure opening 5*a*, so that the surface of the photosensitive drum 6 is subjected to the scanning exposure. The potential of the drum surface portion (exposed portion) subjected to irradiation with the laser light L is decayed, so that the electrostatic latent image corresponding to the scanning exposure pattern is formed on the surface of the photosensitive drum 6 on the basis of a potential contrast between the exposed portion and a drum surface portion (non-exposed portion) which has not been subjected to the irradiation with the laser light The electrostatic latent image is developed as the toner image by the developing means 8. As a developing method, a jumping developing method, a two component developing method, or the like may be used. In the case of the printer, image exposure and reverse development are frequently used in combination.

In this embodiment, the electrostatic latent image is formed by image exposure for exposing an image portion, on which the toner is to be deposited, to light and then is reversely developed with negatively chargeable one component toner (negative toner) by using a developing device of a jumping developing type as the developing means 8. The developing device 8 includes a developer container 81 in which toner (developer) t is retained, a non-magnetic developing sleeve 82 as a developer-carrying member, and a developing blade 83 as a developer layer thickness regulating member. The developing sleeve 82 is rotatably provided at an opening provided to a drum opposing portion of the developer container 81. Inside the developing sleeve 82, a magnet roller 84 is non-rotationally provided. The developing blade 83 is an elastic member and is disposed in such a manner that the blade 83 is bent inwardly against elasticity in contact with the developing sleeve 82. The developing sleeve 82 is in parallel to the photosensitive drum 6 and opposes the photosensitive drum 6 with a predetermined slight gap between it and the photosensitive drum 6. The developing sleeve 82 is rotationally driven in a counterclockwise direction indicated by an arrow at a predetermined speed. Inside the developer container 81, a toner stirring member 89 is provided. The toner stirring member 89 rotates a predetermined speed in interrelation with the rotation of the developing sleeve 82 and supplies the toner t to the developing sleeve 82. At the surface of the developing sleeve 82 on the developer container 81 side, the toner t is magnetically adsorbed and carried due to a magnetic force of the magnet roller 84 and is fed to a developing area, in which the developing sleeve 82 opposes the photosensitive drum 6, by the rotation of the developing sleeve 82. During the feeding, the toner passes through a contact nip between the developing sleeve 82 and the developing blade 83. As a result, the toner is subjected to layer thickness regulation, so that the toner is regulated in appropriate coating amount on the developing sleeve and is negatively charged triboelectrically. By further rotation of the developing sleeve 82, the toner is fed to the developing area which is the opposing portion between the developing sleeve 82 and the photosensitive drum 6. To the developing sleeve 82, a predetermined developing bias is applied through sliding contacts (not shown) by a developing bias power source (not shown) provided to the apparatus main assembly 1A. In this embodiment, the toner on the developing sleeve 82 jumps onto the photosensitive drum 6 to be electrostatically deposited on the electrostatic latent image in the developing area, so that the electrostatic latent image is developed as the toner image.

The control circuit portion 3 rotationally drives a (sheet) feeding roller 20 with predetermined control timing. As a result, one of sheets of a recording material P, as a recording medium, stacked and accommodated in a cassette 21, is separated and fed. The thus fed recording material P passes along a guide plate 22 to reach a registration roller pair 23 configured to be subjected to ON/OFF control of rotation with predetermined control timing. The registration roller pair 23 temporarily stops a leading end of the recording material P in a rotation OFF surface to make correction of oblique movement of the recording material P. Then, the registration roller pair 23 introduces the recording material P into a transfer nip, which is a contact portion between the photosensitive drum 6 and a transfer roller 15, by being turned on for rotation with the predetermined control timing. That is, the recording material P is synchronized with the toner image on the photosensitive drum 6 by the registration roller pair 23 to be sent to the transfer nip. During nip-conveyance of the recording material P through the transfer nip, to the transfer roller 15, a transfer bias of a predetermined potential and an opposite polarity (positive in this embodiment) to the toner charge polarity is applied from a transfer bias power source (not shown). As a result, the toner images on the surface of the photosensitive drum 6 are successively transferred electrostatically onto the surface of the recording material predetermined.

The recording material coming out of the transfer nip is separated from the surface of the photosensitive drum 6 and passes along a conveying device 24 to be introduced into a fixing device (fixing means) 25. The recording material P introduced into the fixing device 25 is heated and pressed, so that the unfixed toner image is fixed on the recording material surface as a fixed image. Then, the recording material P passes through a (sheet) discharge opening 26 to be discharged on a (sheet) discharging tray 27 located outside the apparatus.

The surface of the photosensitive drum 6 after the separation of the recording material is subjected to removal of residual deposited product such as transfer residual toner or the like by the cleaning blade 91 of the cleaning device 9 to be cleaned, thus being repeatedly subjected to image formation. The transfer residual toner or the like removed from the drum surface by the cleaning blade 91 is collected in a residual toner container 92.

Figure 3:
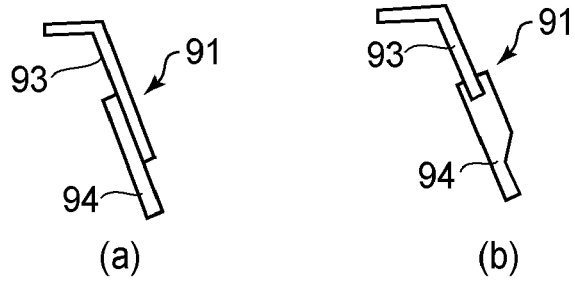
FIGS. 3(*a*) and 3(*b*) are schematic views each showing a shape of a cleaning blade.

The cleaning blade 91 is provided counter-directionally with respect to the drum rotational direction in order to obtain a high cleaning performance to contact the photosensitive drum 6 in the predetermined area so as to create a nip, in which the cleaning blade 91 cleans the surface of the photosensitive drum 6 so as to remove the deposited product such as the transfer residual toner by scraping. The cleaning blade 91 is, as shown in FIGS. 3(*a*) and 3(*b*), constituted by a supporting metal plate 93 and a rubber blade 94. The material for the rubber blade 94 is an elastic rubber such as an urethane rubber. The rubber blade 94 is of two types including a constant thickness shape type (FIG. 3(*b*)) and an irregular shape type (FIG. 3(*b*)) in cross section. In this embodiment, the cleaning blade 91 of the irregular shape type shown in FIG. 3(*b*) is used.

In the drum contact area of the cleaning blade 91, coating or the like as a means for reducing the frictional resistance is not applied. That is, with respect to the cartridge 5, in a fresh state, particles having a lubrication action exerted between the cleaning blade 91 and the photosensitive drum 6 are not applied in the drum contact area of the cleaning blade 91.

Here, with respect to the cartridge 5, a fresh cartridge or the fresh state means a cartridge in an unused state from factory shipment until a user mounts the cartridge to the apparatus main assembly 1A of the image forming apparatus 1 to start use of the cartridge for image formation.

<Photosensitive Drum 6>

Figure 4:
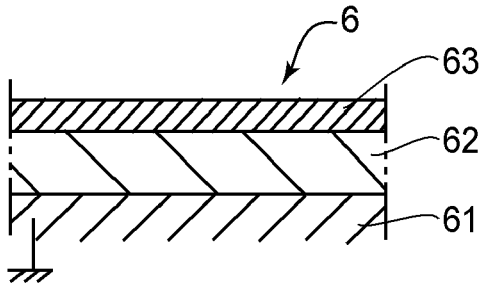
FIG. 4 is a schematic view showing a layer structure of a photosensitive drum.

FIG. 4 is a schematic view of a layer structure of the photosensitive drum 6 as the image bearing member. The photosensitive drum 6 includes an electroconductive support 61 and an electrophotographic photosensitive layer (charge generating layer) 62 formed on the support 61. Further, on the photosensitive layer 62, a surface layer (charge transporting layer) 63 is formed.

The surface layer 63 is formed by applying and drying a coating liquid principally including a charge transporting material, a binder resin material, and a lubricating material which are dissolved in a solvent. As the charge transporting material, it is possible to use various compounds such as triarylamine compounds, hydrazone compounds, stilbene compounds, pyrazoline compounds, oxazole compounds, triarylmethane compounds, triazole compounds, and the like.

As the binder resin material, it is possible to use, e.g., polyester resin, polyacrylic resin, polyvinyl carbazole resin, phenoxy resin, polycarbonate resin, polystyrene resin, polyvinyl acetate resin, polysulfone resin, polyallylate resin, vinylidene chloride-acrylonitrile copolymer resin, and polyvinyl benzol resin.

Further, as the lubricating material, a comb-like polymer is used. The lubricating material is commercially available from Toagosei Co., Ltd. under the trade name of Symac US-270, US-380, US-450, etc. In this embodiment, Symac US-270 is used.

The photosensitive drum 6 in this embodiment has a coefficient of kinetic friction (μ) of 0.40 in the fresh cartridge. The coefficient of kinetic friction is changed to 0.60 to 1.0 in measurement after an initial rotation operation described later. This is because the coefficient of kinetic friction is increased due to abrasion of the surface layer by electric discharge attack and an electric discharge product when the charging bias is applied during the initial rotation operation.

In such a condition, when drive of the photosensitive drum 6 is performed in the absence of the lubricant at the contact portion between the photosensitive drum 6 and the cleaning blade 91, turning-up of the cleaning blade 91 is liable to occur. Particularly, when the coefficient of kinetic friction of the photosensitive drum 6 at its surface is 0.5 or more, the turning-up of the cleaning blade 91 is liable to occur. Incidentally, the measurement of the coefficient of kinetic friction after a preparatory operation for printing is performed after the toner on the surface of the photosensitive drum 6 is removed since the coefficient of kinetic friction of the photosensitive drum 6 alone cannot be accurately measured in the presence of the toner on the photosensitive drum 6.

The measurement of the coefficient of kinetic friction (μ) was performed by using a surface property tester ("HEIDON-14", mfd. by SHINTO Scientific Co., Ltd.) under a normal temperature/normal humidity (25° C./50% RH) environment. Specifically, the cleaning blade 91 was placed in contact with the photosensitive drum 6 in a state in which a certain load was applied to the cleaning blade 91. Then, when the photosensitive drum 6 was rotationally driven at 50 rpm, a frictional force exerted between the photosensitive drum 6 and the cleaning blade 91 was measured as an amount of strain of a strain gauge attached to the cleaning blade 91 side, followed by conversion into a tensile load.

The coefficient of kinetic friction can be obtained from [force (g) applied onto photosensitive drum 6]/[load (g) applied onto blade] when the photosensitive drum is in operation. The blade used was an urethane rubber blade (a rubber hardness=67 degrees) and the measurement was performed under a load of 100 gf at an angle of 27 degrees with respect to a width direction.

<Operation Sequence of the Image Forming Apparatus>

Figure 5:
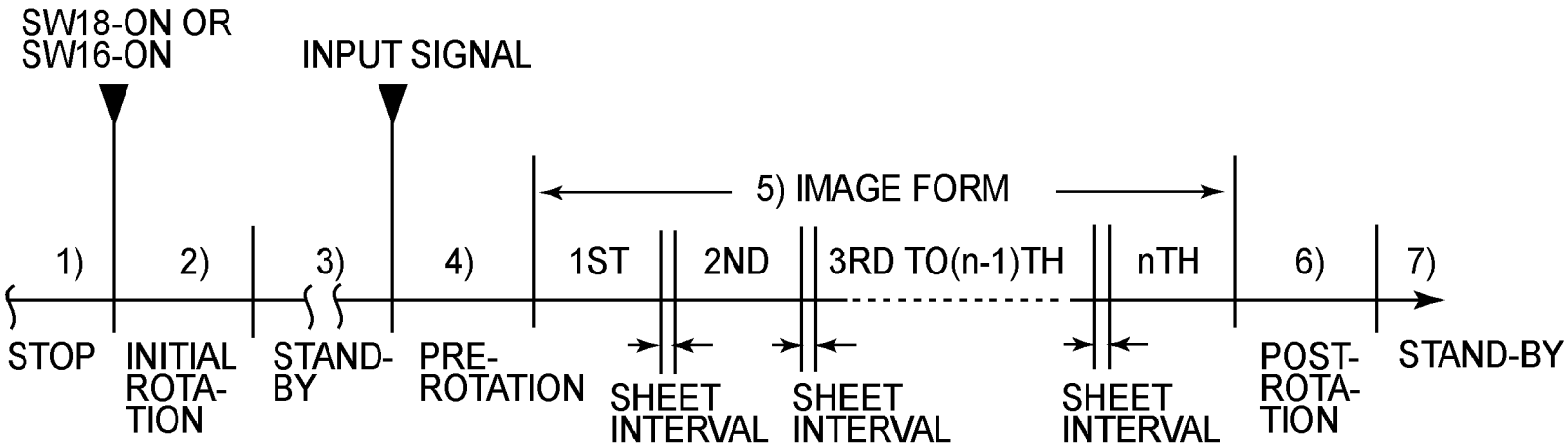
FIG. 5 is an operational process chart of the image forming apparatus.

FIG. 5 is an operation process chart of the image forming apparatus.

1) Rest State

When the power source of the image forming apparatus is turned off, i.e., when the main (power) switch 18 is turned off or the door switch 16 is turned off by opening the door 10, the power source circuit is opened (power OFF) and thus the image forming apparatus is kept in a rest (stop) state.

2) Initial Rotation Operation (Pre-Multi-Rotation Operation)

This operation is a starting operation (actuating operation) executed when the power source of the image forming apparatus is turned on. That is, an operation for effecting warming of required process devices accompanied with the rotational drive of the photosensitive drum 6 by actuating a driving motor (main motor) (not shown) when the power source of the image forming apparatus is turned on.

The time when the power source of the image forming apparatus is turned on is the time when the main switch in an OFF state is turned on in a state in which the door switch 16 is an ON state (the door 10-CLOSE) or the time when the door switch 16 in the OFF state (the door 10-OPEN) is turned on (the door-CLOSE) in a state in which the main switch 18 is in the ON state. In either case, the power source circuit is closed (power ON), so that the image forming apparatus is kept in an operable state.

The initial rotation operation is a preparatory operation for causing the image forming apparatus to stable image formation. For example, control such that the state of the cartridge 5 is detected and settings of proper charging, developing, and transfer biases are made depending on the detected state is effected. It is also possible to effect process control such that in order to uniformize the surface potential of the photosensitive drum 6, a certain charging bias is applied or light exposure is made.

3) Stand-By

After the predetermined initial rotation operation is completed, the drive of the driving motor is stopped, so that the image forming apparatus is kept in a stand-by state until an image formation start signal S is inputted.

4) Pre-Rotation Operation

On the basis of the input of the image formation start signal S, the driving motor is driven again, so that a predetermined pre-operation for image formation accompanied with the rotational drive of the photosensitive drum 6 is performed.

More specifically, the pre-operation is performed in the order of a: receiving of the image formation start signal S, b: image data expansion by a formation (in which an expansion time varies depending on an amount of the image data and a processing speed of the formatter), and c: start of the pre-rotation operation.

Incidentally, in the case where the image formation start signal S is inputted during the initial rotation operation of the above 2), after the completion of the initial rotation operation, the pre-rotation operation of 4) is performed with no stand-by of 3).

5) Image Forming Operation

When the pre-rotation operation is completed, subsequently, an image forming operation on predetermined are sheet (mono-print) or an image forming operation on a predetermined number of plural sheets (a continuous image forming job: multi-print) is performed, so that an image-formed recording material is outputted. "SHEET INTERVAL" is an interval portion between a trailing end of a recording material and a leading end of a subsequent recording material.

6) Post-Rotation Operation

The driving motor is continuously driven for a predetermined time even after the completion of the image forming operation on the predetermined are sheet or the predetermined number of plural sheets, so that a developer image formation completing operation accompanied with the rotational drive of the photosensitive drum 6 is performed.

7) Stand-By

When the post-rotation operation is completed, the drive of the driving motor is stopped and the image forming apparatus is kept in the stand-by state until a subsequent image formation start signal S is inputted. When the subsequent image formation start signal S is inputted, the sequence goes to the pre-rotation operation of the above 4).

<Exchange of Cartridge 5>

With the use of the cartridge 5 for the image formation, the toner (developer) t accommodated in the developer container 81 of the developing device 8 is consumed. Then, when the developer is consumed to such an extent that it is impossible for the user which has purchased the cartridge to obtain a satisfactory image quality, exchange of an old cartridge for a fresh cartridge is needed.

Therefore, e.g., a means for detecting remaining developer amount (not shown) is provided and a detect remaining amount value is compared with a preset threshold value for advance notice or warning of end of the lifetime of the cartridge by the control circuit portion 3. With respect to the cartridge showing the detected remaining (developer) amount value less than the threshold value, the advance notice or warning of end of the lifetime of the cartridge is displayed on a display portion (not shown) of the operating portion 4.

The exchange of the old cartridge 5 for the fresh cartridge 5 is performed, as described above, by demounting the old cartridge from the cartridge mounting portion 12 after opening the door 10 and then by mounting the fresh cartridge 5 to the cartridge mounting portion 12. In this case, as described above, the door 10 is opened, so that the door switch 16 is turned off to open the power source circuit even when the main switch 18 is on. As a result, the image forming apparatus is kept in the rest state to ensure electrical safety. The door 10 is closed again, so that the door switch 16 is turned on to close the power source circuit of the image forming apparatus. In this case, the control circuit portion 3 executes the initial rotation operation of 2) described above and then shifts the sequence to the stand-by of 3) described above. In the case where the image forming job is interrupted, the image formation on remaining sheets is carried out by performing the initial rotation operation of 2) and then performing the pre-rotation operation of 4) with no stand-by of 3) and then by shifting the sequence to the image forming operation of 5).

Further, not only in the case of the exchange of the old cartridge 5 for the fresh cartridge 5 but also in the case of jam clearance, maintenance and inspection of the image forming apparatus, and the like, the door 10 is opened and then demounting of the cartridge 5 is performed. Also in this case, the door switch 16 is turned off to open the power source circuit by opening the door 10, so that the image forming apparatus is kept in the rest state to ensure the electrical safety. Further, after the jam clearance, the maintenance and inspection of the image forming apparatus, or the like is completed, the cartridge 5 is mounted again. Then, the door 10 is closed, so that the door switch 16 is turned on to close the power source circuit.

Also, in this case, the control circuit portion 3 executes the initial rotation operation of 2) described above and then shifts the sequence to the stand-by of 3) described above. In the case where the image forming job is interrupted, the image formation on remaining sheets is carried out by performing the initial rotation operation of 2) and then performing the pre-rotation operation of 4) with no stand-by of 3) and then by shifting the sequence to the image forming operation of 5).

In summary, the control circuit portion 3 has a control mode in which the initial rotation operation of the image forming apparatus accompanied with the rotational drive of the photosensitive drum 6 is performed when the power source of the image forming apparatus is turned on. The time when the power source of the image forming apparatus is turned on is the time when the main switch in the OFF state is turned on in the state in which the door switch 16 is in the ON state (the door 10-CLOSE) or the time when the door switch 16 in the OFF state (the door 10-OPEN) is turned on (the door-CLOSE) in the state in which the main switch 18 is in the ON state.

<Developer Supply Sequence Control>

Figure 1:
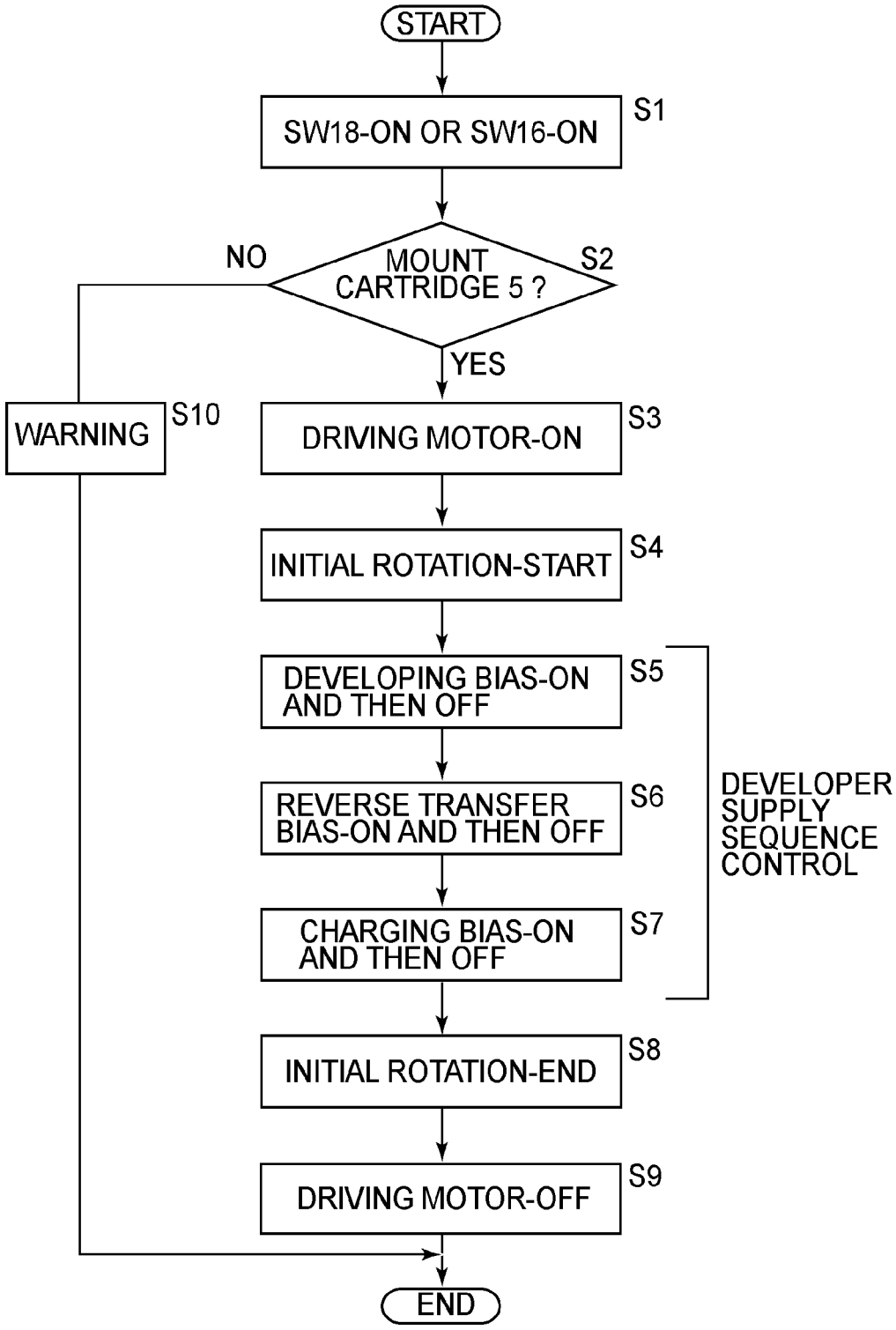
FIG. 1 is a flow chart of control in Embodiment 1.

The above-described control mode includes the developer supply sequence control in which the developing bias is applied to the developing means 8 to deposit the toner t on the surface of the photosensitive drum 6 in the state in which the charging bias is not applied to the charging means 7. FIG. 1 is a flow chart of the initial rotation operation including the developer supply sequence control.

Step S1: The power source circuit is closed by turning on the power source of the image forming apparatus (the power source switch 18-ON or the door switch 16-ON).

Step S2: The control circuit portion 3 judges whether or not the cartridge 5 is mounted on the basis of a signal from a cartridge presence-absence detecting means 31 (FIG. 2).

The cartridge presence-absence detecting means 31 is, e.g., a micro-switch which is turned on by being pushed by the cartridge 5 when the cartridge 5 is mounted and is turned off when the cartridge 5 is not mounted. The cartridge presence-absence detecting means 31 is in the OFF state even in both of the case where the cartridge 5 is inserted into the apparatus main assembly 1A and the case where the cartridge 5 is not properly mounted to the mounting portion 12.

Steps S3, S4 and S10: The control circuit portion 3 turns the driving motor on (S3) when the cartridge 5 is mounted, thus starting the initial rotation operation (S4). By the turning-on of the driving motor, the photosensitive drum 6 and the developing roller 82 and rotated. The control circuit portion 3 causes the operating portion 4 to produce warming display (error message), to the effect that the cartridge is not mounted or is improperly mounted, on the display portion while keeping the driving motor in the OFF state in the case where the cartridge 5 is not mounted (including the case where the cartridge 5 is not properly mounted (S10).

Step S5: The control circuit portion 3 starts the application of the developing bias to the developing sleeve 82 in a state in which the charging bias is not applied to the charging roller 7 after driving torques of the photosensitive drum 6 and the developing sleeve 82 are stabilized.

In this embodiment, the developing bias includes a AC voltage of 1600 V in terms of the peak-to-peak voltage and a DC voltage of −400 V. The drum potential is approximately 0 V, so that the negative toner carried on the developing sleeve 82 jumps to the photosensitive drum 6 to be deposited on the photosensitive drum surface in the entire effective area of the developing sleeve 82.

Figure 6:
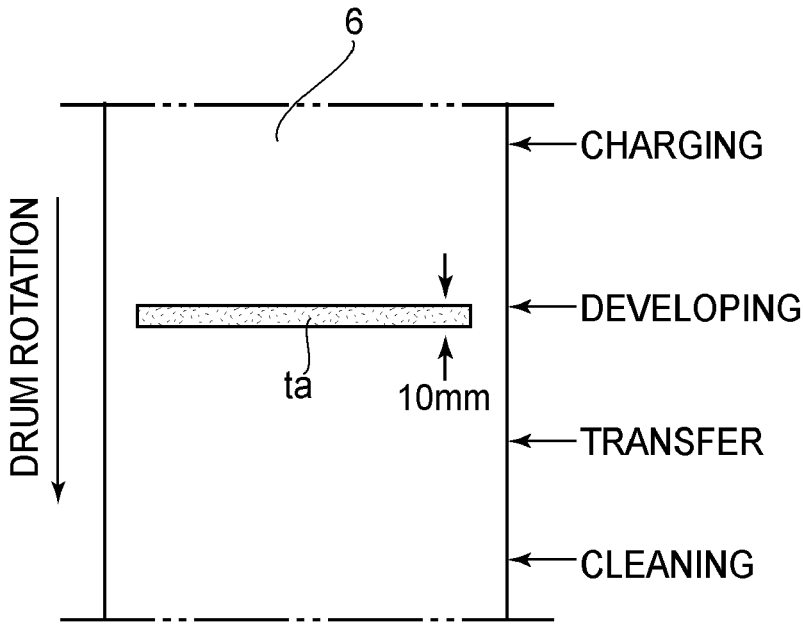
FIG. 6 is a schematic development view of the photosensitive drum in a state in which a developer is supplied in developer supply sequence control.

In this embodiment, an application time of the developing bias is 67 ms (milliseconds) and a toner image (black band) ta being about 10 mm in width with respect to the drum rotational direction (FIG. 6) is formed on the photosensitive drum 6. Incidentally, in this embodiment, as the developing bias, a voltage in the form of the DC voltage biased with the AC voltage is used but only the DC voltage may also be used.

Step S6: The control circuit portion 3 applies a reverse transfer bias to the transfer roller 15 immediately before the black band ta reaches the contact nip (transfer portion) between the photosensitive drum 6 and the transfer roller 15 by the rotation of the photosensitive drum 6 subsequent to the formation of the black band ta on the photosensitive drum 6. The reverse transfer bias is a repulsive bias (cleaning bias) of an identical polarity to the toner charge polarity. In this embodiment, the reverse transfer bias of −1000 V is applied from a reverse transfer bias application power source (not shown). This is because the transfer roller 15 is prevented from being contaminated with the toner by transfer of the black band ta from the photosensitive drum 6 onto the transfer roller 15 during passing of the transfer portion of the black band ta. The application of the reverse transfer bias is terminated after the black band ta passes through the transfer portion.

Then the black band ta having passed through the transfer portion reaches the contact nip between the cleaning blade 91 and the photosensitive drum 6 by further rotation of the photosensitive drum 6. The toner of the black band ta functions as the lubricant by stagnating in the contact nip between the cleaning blade 91 and the photosensitive drum 6. As a result, it was possible to solve the problems such as the noise, turning-up, and breakage of the blade at the initial use stage of the process cartridge 5.

Step S7: The control circuit portion 3 applies the charging bias to the charging roller 7 for a predetermined time. In this embodiment, the charging bias includes an AC voltage of 1600 V in terms of the peak-to-peak voltage and a DC voltage of −600 V and is applied for a time corresponding to 2-full circumference of the drum. As a result, the drum surface potential is kept at approximately −600 V to decrease potential non-uniformity caused by the reverse transfer bias application or the like, so that proper image formation is effected when the procedure goes to the image forming operation.

Steps S8 and S9: The control circuit portion 3 ends the initial rotation operation when warming of other required process devices is completed (S8) and stops the drive of the driving motor (S9), thus keeping the image forming apparatus in the stand-by state. The control circuit portion 3 may also execute the image formation on remaining sheets by performing the pre-rotation operation of 4) with no stand-by and then performing the image forming operation of 5) in the case where the image forming job is interrupted.

In the steps S5 to S7 of the above-described steps, the developer supply sequence control is executed during the initial rotation operation. Thus, during the initial rotation operation, the developer supply sequence control is effected in a state in which the photosensitive drum surface layer exhibits high lubricity, so that a lubricant function of the toner is imparted. Thereafter, even when the lubricating material of the photosensitive drum surface layer is abraded and the friction resistance at the surface of the photosensitive drum is increased, it is possible to prevent the noise, the turning-up, and the like of the cleaning blade by the lubrication action of the toner intervened between the photosensitive drum and the cleaning blade.

Figure 7:
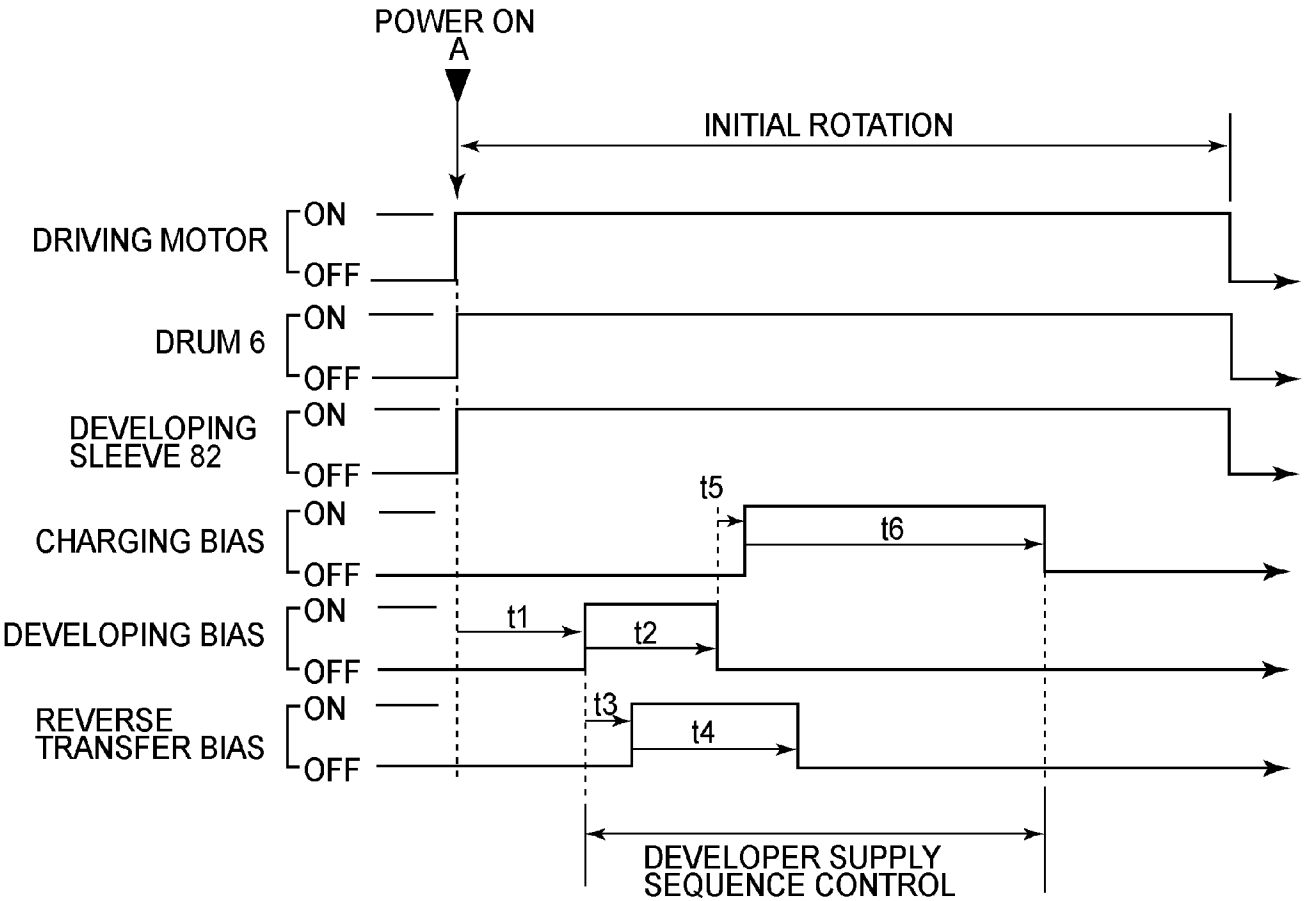
FIG. 7 is a sequence chart during an initial rotation operation.

Next, the developer supply sequence control will be described with reference to a sequence chart of FIG. 7, wherein an abscissa represents a time. When the mounting of the cartridge 5 is detected in the steps in FIG. 1, the driving motor is in the ON state. As a result, the rotations of the photosensitive drum 6 and the developing sleeve 82 are started (ON). Then, after the lapse of a time t1 in which the rotations of the photosensitive drum 6 and the developing sleeve 82 are stabilized, the developing bias is applied for a predetermined time t2. In this embodiment, the time t1 was 500 ms and the time t2 was 67 ms. The drum potential is kept at approximately 0 V, so that the negative toner carried on the developing sleeve 82 jumps to the photosensitive drum 6 to deposition the drum surface in the entire effective area of the developing sleeve 82. In this embodiment, by the application of the developing bias for the time t2=67 ms, the black band (toner image) ta is formed on the photosensitive drum 6 in a width of about 10 mm with respect to the drum rotational direction.

Then, the reverse transfer bias to the transfer roller 15 is applied before the time when the black band ta on the drum moves to the transfer portion, so that the black band ta on the drum is not transferred onto the transfer roller 15 side. In this embodiment, the time in which the black band ta formed on the photosensitive drum 6 at the developing position reaches the transfer position is 15 ms, so that a time t3 is set at 10 ms. The reverse transfer bias is applied for a time t4=70 ms longer than the developing time t2=67 ms.

On the other hand, the charging bias is applied for a time t6 corresponding to 2-full circumference or more of the drum after the lapse of a time t5 from the end of the developing bias application. Specifically, the time t5 was 5 ms and the time t6 was 1350 ms.

Incidentally, timing of the application of the charging bias may be set appropriately so long as an end position of an area in which the toner on the photosensitive drum 6 is intended to be deposited has passed the charging position.

As described above, the above-mentioned developer supply sequence control is executed during the initial rotation operation performed when the power source of the image forming apparatus is turned on. As a result, the toner-deposited area reaches the nip between the cleaning blade 91 and the photosensitive drum 6 before the area of the photosensitive drum 6 opposing the charging roller 7 at the time when the charging bias is applied to the charging roller reaches the nip. For that reason, in the image forming apparatus using the photosensitive drum 6 having the high-lubricity surface layer, it is possible to supply and stagnate the toner in the drum contact area of the cleaning blade 91 before the surface layer is abraded. Therefore, it was possible to solve the problems such as the noise, turning-up, and breakage of the blade at the initial use stage of the cartridge 5.

Embodiment 2

In this embodiment, whether or not the cartridge 5 mounted to the apparatus main assembly 1A is the fresh cartridge is detected and in the case where the cartridge 5 is the fresh cartridge, the above-described developer supply sequence control is carried out in the above-described initial rotation operation.

That is, a maximum functional effect is achieved by the above-described developer supply sequence control in the case where the cartridge 5 is the fresh cartridge. Therefore, in this embodiment, whether or not the cartridge 5 mounted to the apparatus main assembly 1A is the fresh cartridge is detected and in the case where the cartridge 5 is the fresh cartridge, the developer supply sequence control is carried out. As a result, the toner is supplied and stagnated in the drum contact area of the cleaning blade 91, so that the problems concerning the cleaning blade are solved.

Figure 8:
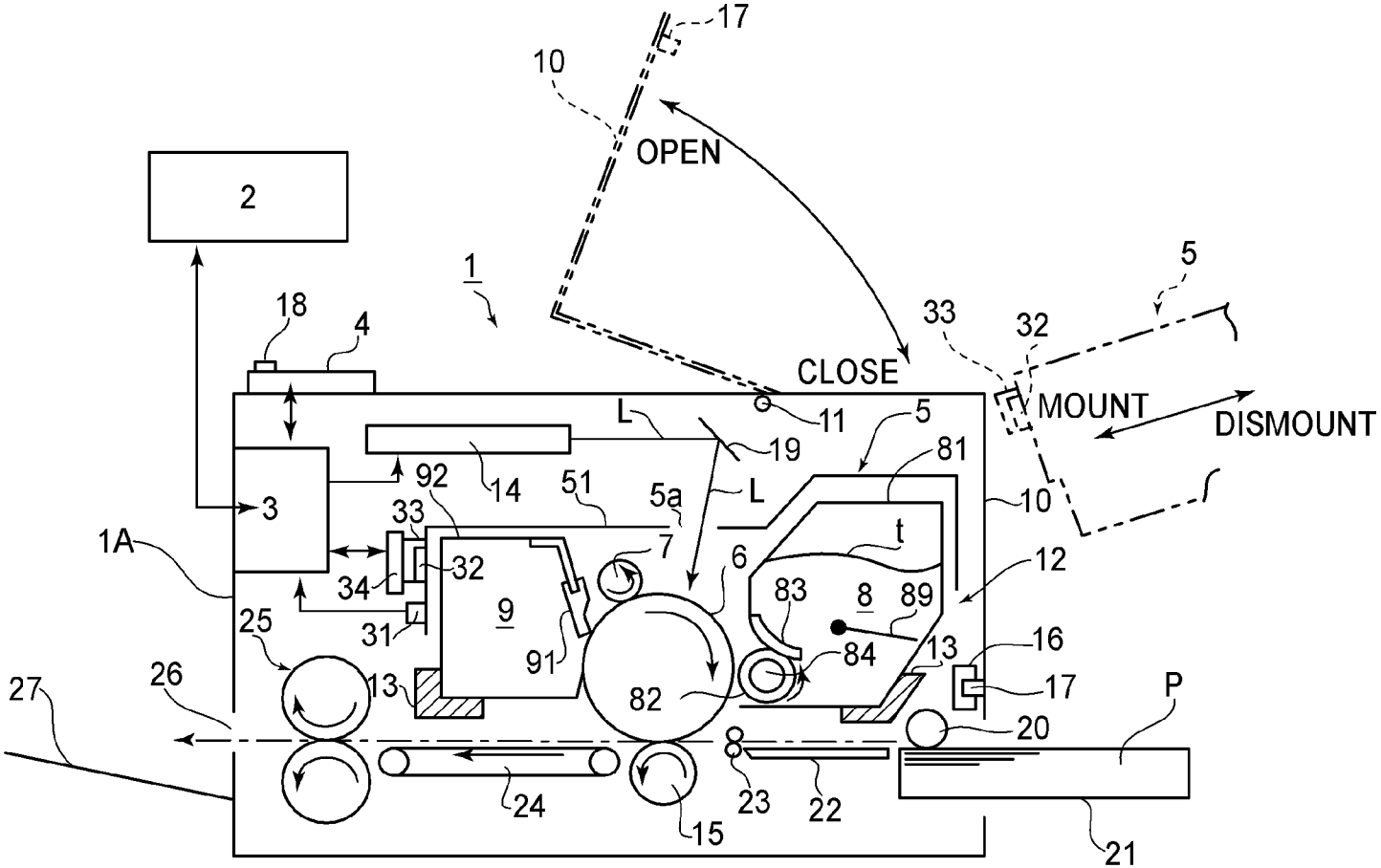
FIG. 8 is a schematic view of an image forming apparatus in Embodiment 2.

In this embodiment, judgment as to whether or not the cartridge 5 mounted to the apparatus main assembly 1A is the fresh cartridge is made by using a non-volatile storing means (a storing medium for storing information; hereinafter referred to as a memory) 32 provided to the cartridge 5, as shown in FIG. 8.

On the rear surface side of the cartridge 5 (on an insertion end-side surface of the cartridge 5 with respect to the apparatus main assembly 1A), the memory 32 and a cartridge-side transmitting portion 33 for controlling reading and writing of information with respect to the memory 32. The memory 32 and the transmitting portion 33 are integrally supported on a substrate and are provided to the cartridge 5. Further, in a state in which the cartridge 5 is mounted in the apparatus main assembly 1A in a predetermined manner, the cartridge-side transmitting portion 33 opposes and contacts an apparatus main assembly-side transmitting portion 34 in a predetermined manner.

As a result, in a state in which the power source is turned on (in the state of the main switch 18-ON and the door switch 16-ON), the control circuit portion 3 on the apparatus main assembly 1A side and the memory 32 on the cartridge 5 side are placed in an electrically communicatable state through the transmitting portions 34 and 33. That is, the reading of the memory content of the memory 32 by the control circuit portion 3 and the writing of the information in the memory 32 are enabled. As the memory 32, an electronic memory of a normal semiconductor can be used with no particular limitation.

In this embodiment, the cartridge-side transmitting portion 33 and the apparatus main assembly-side transmitting portion contact each other to perform reading/writing data communication between the control circuit portion 3 and the memory 32. However, the data communication may also be performed in a non-contact state through electromagnetic radiation.

In the above-described constitution, an electrical circuit for performing the reading and the writing of the information with respect to the memory 32 is created by the control circuit portion 3.

Cartridge characteristic values depending on characteristic of individual cartridges 5 and parameters and the like for charging a process condition are stored in the memory during factory shipment.

In this embodiment, as one of the parameters (storing information, detection information) stored in the memory 32, information on judgment as the whether or not the cartridge 5 is the fresh cartridge (fresh cartridge history information) is stored. Then, on the basis of this information, the control circuit portion 3 judges whether or not the cartridge 5 mounted in the apparatus main assembly 1A is the fresh cartridge.

A fresh cartridge detecting means (a discriminating means) for detecting whether or not the cartridge 5 mounted in the apparatus main assembly 1A is the fresh cartridge is not limited to the memory 32 as described above. For example, a means for discriminating whether or not the cartridge 5 is the fresh cartridge by detecting ON/OFF of the electrical circuit through a fuse or the like provided in the cartridge 5 may also be employed.

The constitutions of the apparatus main assembly 1A other than that of the fresh cartridge detecting means and the constitution of the cartridge 5 are the same as those in Embodiment 1, thus being omitted from redundant description.

Figure 9:
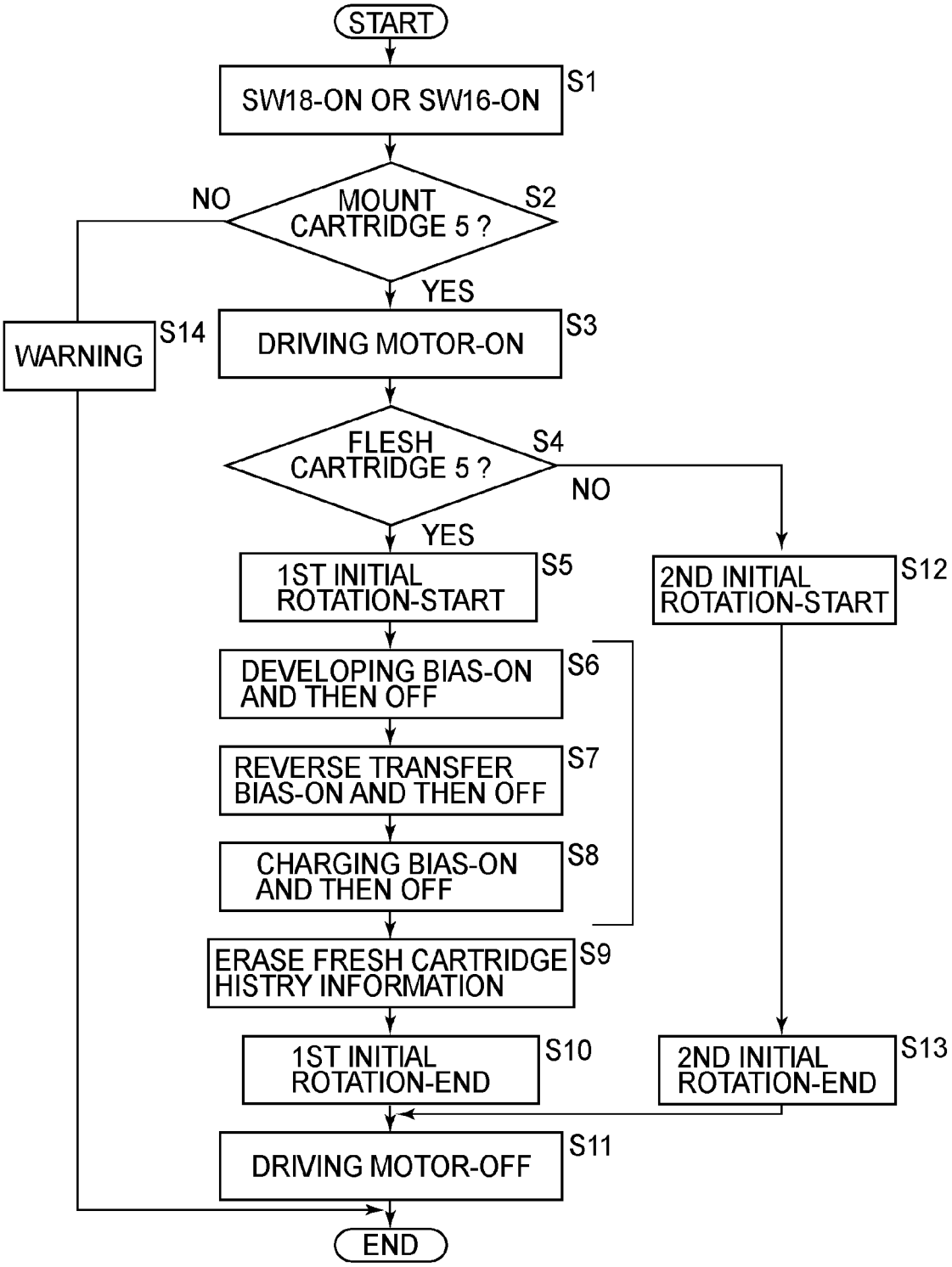
FIG. 9 is a flow chart of control in Embodiment 2.

With reference to a flow chart of FIG. 9, initial rotation operation control in this embodiment will be described.

Step S1: The power source circuit is closed by turning on the power source of the image forming apparatus (the power source switch 18-ON or the door switch 16-ON).

Steps S2 and S14: The control circuit portion 3 judges whether or not the cartridge 5 is mounted on the basis of a signal from a cartridge presence-absence detecting means 31. In the case where the control circuit portion 3 judges that the cartridge 5 is mounted in the apparatus main assembly 1A, the procedure goes to a step S3. The control circuit portion 3 causes the operating portion 4 to produce warming display, to the effect that the cartridge is not mounted or is improperly mounted, on the display portion while keeping the driving motor in the OFF state in the case where the control circuit portion 3 judges that the cartridge 5 is not mounted (including the case where the cartridge 5 is not properly mounted (S14).

The cartridge presence-absence detection is performed by using the memory 32, so that it is also possible to employ a constitution in which the provision of the means 31 is omitted. That is, the control circuit portion 3 judges that the cartridge 5 is mounted in the case where the control circuit portion 3 is communicatable with the memory 32 on the cartridge 5 side. In the case where the control circuit portion 3 cannot communicate with the memory 32, the control circuit portion 3 judges that the cartridge 5 is not mounted (or that the cartridge 5 is not properly mounted).

Steps S3 and S4: The control circuit portion 3 turns on the driving motor when the cartridge 5 is mounted. Further, the control circuit portion 3 judges whether or not the mounted cartridge 5 is the fresh cartridge. This judgment is made by reading the information on whether or not the cartridge 5 is the fresh cartridge (the fresh cartridge history information), stored in the cartridge 5-side memory 32 through the transmitting portions 34 and 33.

Steps S5 and S12: In the case where the cartridge 5 is judged as the fresh cartridge, the procedure goes to a first initial rotation operation (S5). When the cartridge 5 is not the fresh cartridge, the procedure goes to a second initial rotation operation (S12).

Steps S6 to S8: The first initial rotation operation is an operation including the developer supply sequence control (S6 to S8) similarly as in the initial rotation operation described in Embodiment 1.

Steps S9 to S11: The control circuit portion 3 erases the fresh cartridge history information stored in the memory 32 when the developer supply sequence control (S6 to S8) is completed (S9: writing for erasing the information, on whether or not the cartridge 5 is the fresh cartridge, in the memory 32).

Then, the control circuit portion 3 ends the initial rotation operation when warming of other required process devices is completed (S10) and stops the drive of the driving motor (S11), thus keeping the image forming apparatus in the stand-by state. The control circuit portion 3 may also execute the image formation on remaining sheets by performing the pre-rotation operation of 4) with no stand-by and then performing the image forming operation of 5) in the case where the image forming job is interrupted.

Step S12: The second initial rotation operation is an operation which does not include the developer supply sequence control (S6 to S8). The control circuit portion 3 applies the charging bias to the charging roller 7 for a time corresponding to the 2-full circumference or more of the drum after the photosensitive drum 6 and the developing sleeve 82 are driven. This charging bias application is made to keep the drum potential at a constant level in order to obtain a proper electrostatic latent image. When warming of other required process devices is completed, the second initial rotation operation is ended (S13) to stop the drive of the driving motor (S11), so that the image forming apparatus is kept in the stand-by state. In the case where the image forming job is interrupted, the control circuit portion 3 performs the pre-rotation operation of 4) described above with no stand-by and the procedure goes to the image forming operation of 5) to carry out the image formation on remaining sheets.

As described above, during the initial rotation operation executed when the power source is turned on, whether or not the cartridge 5 mounted in the apparatus main assembly 1A is the fresh cartridge is detected. Then, only in the case where the cartridge 5 is the fresh cartridge, the developer supply sequence control is effected during the initial rotation operation, so that it is possible to prevent the noise and turning-up of the cleaning blade.

In summary, the cartridge 5 is provided with the storing medium 32 for storing the information and the control circuit portion 3 detects the information stored in the storing medium 32 and judges whether or not the developer supply sequence control is effected during the initial rotation operation on the basis of the detected information. The detected information is whether or not the cartridge 5 mounted in the apparatus main assembly 1A is the fresh cartridge.

Embodiment 3

In this embodiment, in addition to the constitution of Embodiment 2, a remaining toner seal detecting means (a remaining sealing member detecting means) is provided.

Figure 10:
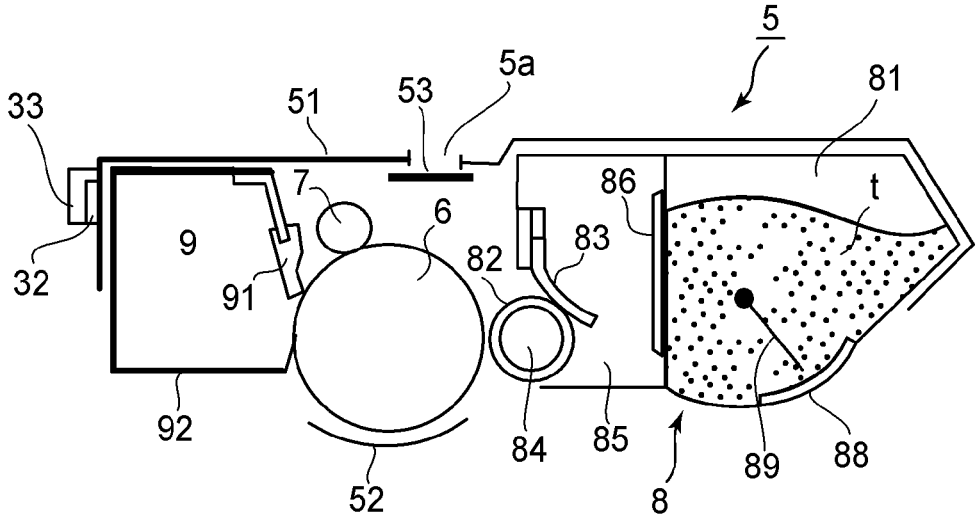
FIGS. 10(*a*) and 10(*b*) are schematic views showing a process cartridge in Embodiment 3 before and after unsealing of the process cartridge, respectively.
Figure 10:
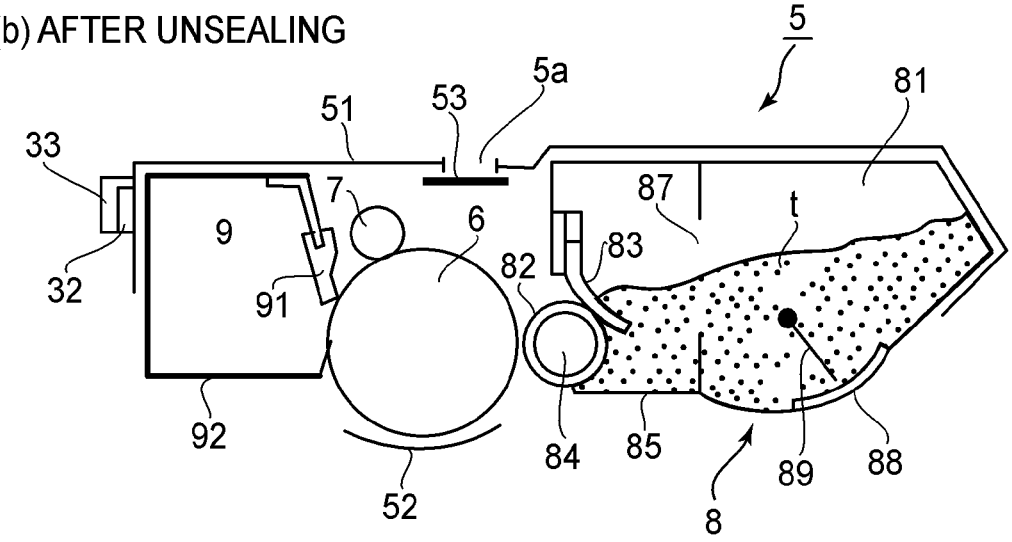

FIG. 10(*a*) is a schematic cross-sectional view of the process cartridge 5 before a toner seal for the process cartridge 5 is removed by drawing (before unsealing) in this embodiment. The developing device 8 of this cartridge 5 includes a developing (device) portion 85 to which the developing sleeve 82 as the developer carrying member for feeding (supplying) the toner (the developer) to the photosensitive drum 6. This developing portion 85 and the developer container 81 in which the toner t is retained are separated (isolated) from each other through a toner seal (a sealing member) 86. In the fresh cartridge 5, by this toner seal 86, the toner t in the developer container 81 is hermetically confined in the developer container 81, thus being prevented from flowing into the developing portion 85. As a result, it is possible to prevent toner leakage during transportation or the like of the fresh cartridge 5. A drum shutter 52 moves to a closing position in which the lower surface of the photosensitive drum 6 is covered and protected when the cartridge 5 is demounted from the apparatus main assembly 1A. An exposure portion shutter 53 moves to position in which the exposure opening 5*a* is closed when the cartridge 5 is demounted from the apparatus main assembly 1A.

The user unseals the developer container 81 by drawing and removing the toner seal 86 in a predetermined procedure before the start of use of the fresh cartridge 5, i.e., before the fresh cartridge 5 is mounted in the apparatus main assembly 1A. FIG. 10(*b*) shows a state in which the toner seal 86 is drawn and removed (after the unsealing). The toner seal 86 is drawn and removed, so that the toner t in the developer container 81 is fed from the opening 87 to the developing portion 85, thus being supplied to the developing sleeve 82. As a result, the cartridge 5 is usable.

In this case, it is assumed that the user mounts the fresh cartridge 5 in the apparatus main assembly 1A and turns on the power source while the user forgets about drawing (and removing) the toner seal 86 during the mounting of the fresh cartridge 5 in the apparatus main assembly 1A. In this case, when the initial rotation operation in Embodiment 1 or the first initial rotation operation in Embodiment 2 is started by the turning-on of the power source, the developing bias is applied to the developing sleeve 82 but the toner is left hermetically confined in the developer container 81. For that reason, feeding of the toner to the developing sleeve 82 and supply of the toner to the photosensitive drum 6 are not performed. Therefore, the toner cannot be supplied and stagnated in the drum contact area of the cleaning blade 91. For that reason, there is a possibility of an occurrence of the noise, turning-up, and breakage of the cleaning blade.

In this embodiment, in order to prevent the occurrence of the above phenomena, the remaining toner seal detecting means described below is provided so as to carry out the initial rotation operation including normal developer supply sequence control with higher reliability.

In this embodiment, detecting of the remaining toner seal 86 is performed by using a remaining toner amount detecting means for detecting that a remaining amount of the toner t in the developing portion 85 in the developer container is small by utilizing a change in electrostatic capacity of the toner t.

Figure 11:
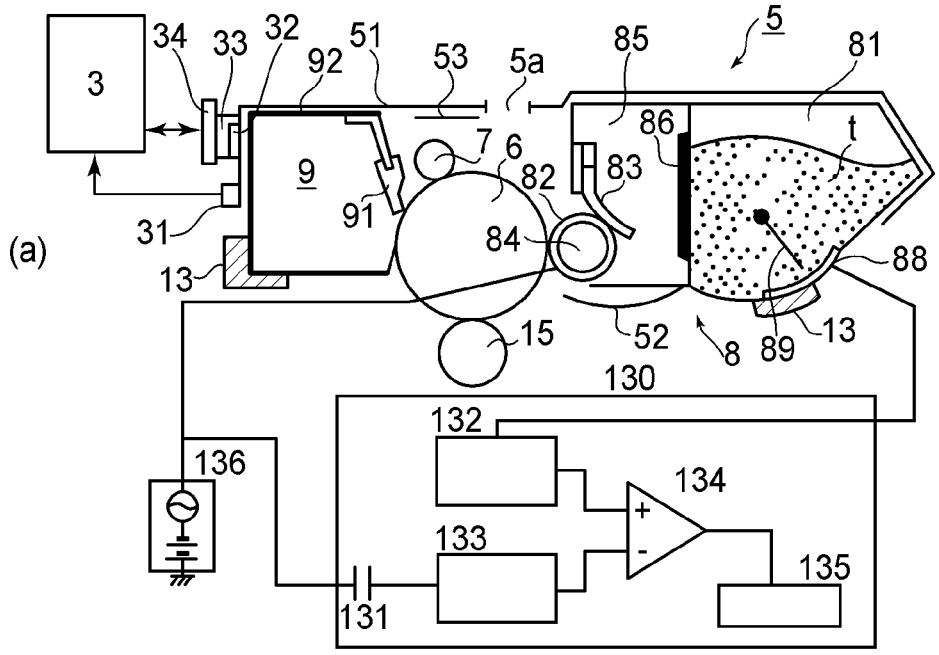
FIGS. 11(*a*) and 11(*b*) are schematic views showing a mounted state of the process cartridge in an apparatus main assembly before and after unsealing of a toner seal, respectively.
Figure 11:
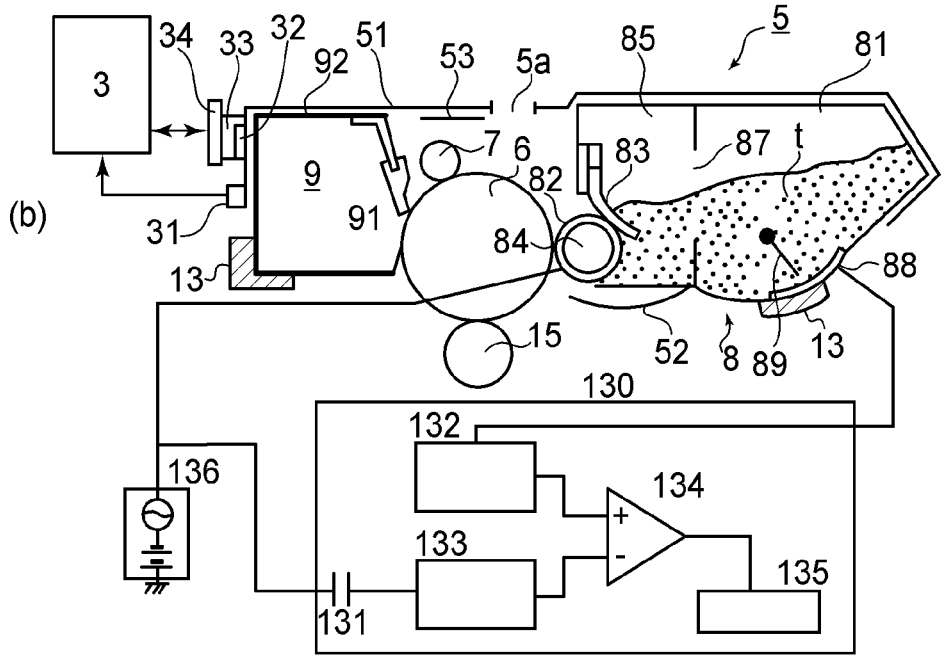

FIG. 11(*a*) shows a state in which the user has mounted the fresh cartridge 5 in the apparatus main assembly 1A while forgetting about drawing and removing the toner seal 86 during the mounting of the fresh cartridge 5 in the apparatus main assembly 1A. FIG. 11(*b*) shows a state in which the cartridge 5 from which the toner seal 86 has been drawn and removed before the start of use. In the state in which the cartridge 5 is mounted in the apparatus main assembly 1A, the drum shutter 52 and the exposure portion shutter 53 have moved to the associated open positions, respectively.

At the bottom of the developer container 81, an antenna plate 88 formed of metal is disposed as an electrode for the remaining toner amount detection. An AC bias as the developing bias is applied between the antenna plate 88 and the developing sleeve 82. A remaining toner amount detecting circuit 130 is provided to the control circuit portion 3. An electrostatic capacity value between the antenna plate 88 and the developing sleeve 82 obtained by an electrostatic capacity detecting circuit 132 in the remaining toner amount detecting circuit 130 and an electrostatic capacity value of comparative capacitor 131 obtained by an electrostatic capacity detecting circuit 133 in the remaining toner amount detecting circuit 130 are compared by a comparator 134. On the basis of a difference between the two electrostatic capacity values compared by the comparator 134, a remaining toner amount is calculated by a processing circuit 135 to determine a percentage (%) of a toner amount in the case of the fresh cartridge.

Here, as shown in FIG. 11(*a*), in the case where the user has mounted the fresh cartridge 5 in the apparatus main assembly 1A and has turned on the power source while forgetting about drawing and removing the toner seal 86 during the mounting of the cartridge 5 in the apparatus main assembly 1A, the developer container 81 is left unsealed by the toner seal 86. Therefore, there is no toner in the developing portion 85, so that the electrostatic capacity value detected by the electrostatic capacity detecting circuit 132 is high due to the presence of the toner seal 86 between the developing sleeve 82 and the antenna plate 88. In this embodiment, the control circuit portion 3 judges that the cartridge 5 in a state in which the user has forgot about drawing and removing the toner seal 86 when the electrostatic capacity detecting circuit 132 in the remaining toner amount detecting circuit 130 detects a high electrostatic capacity value equal to or more than a predetermined value.

Figure 12:
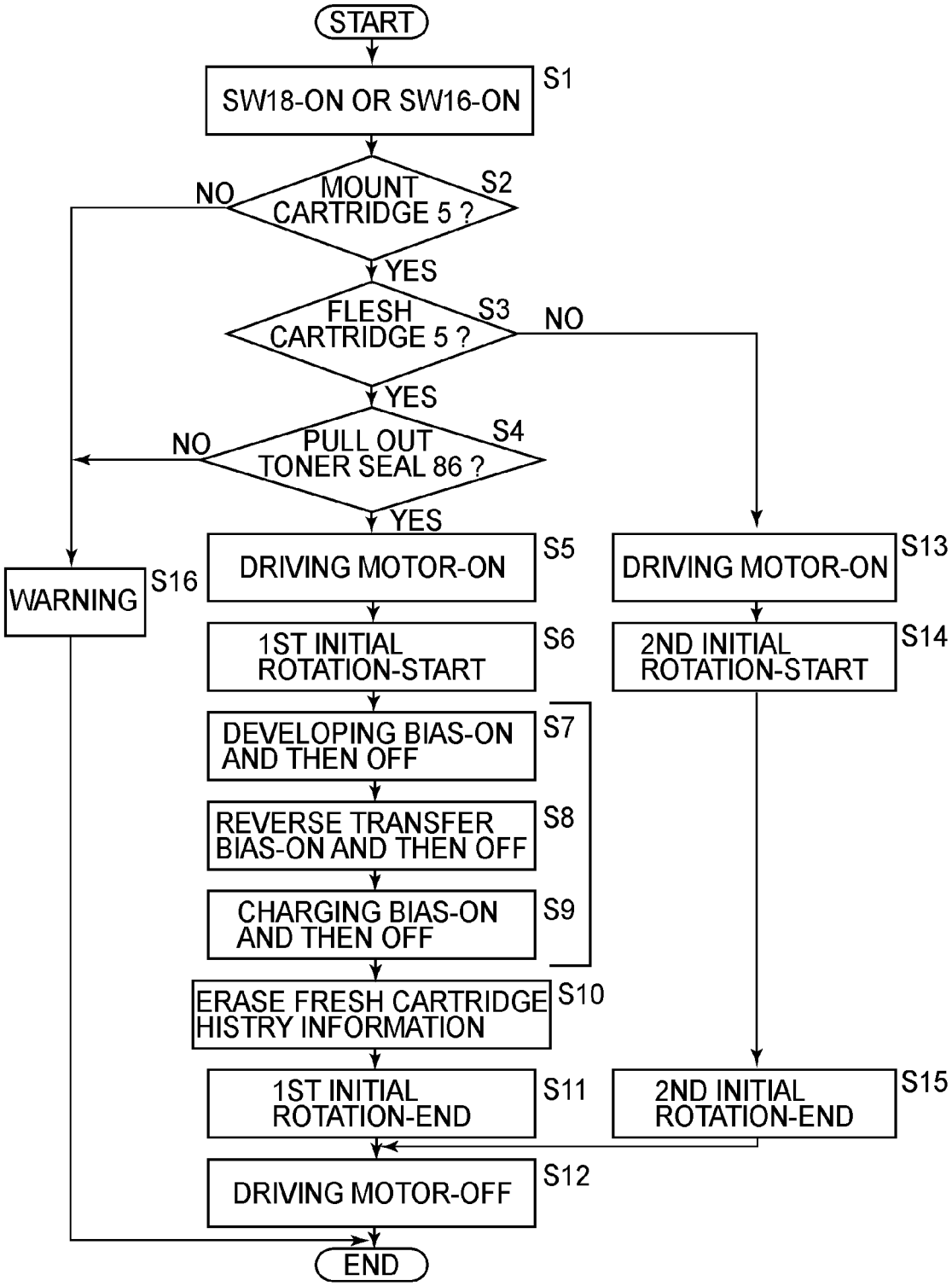
FIG. 12 is a flow chart of control in Embodiment 3.

Next, this embodiment will be described with reference to a flow chart of FIG. 12.

The constitution of the above-described developing device 8, the constitutions of the apparatus main assembly 1A other than that of the remaining toner seal detecting means using the remaining toner amount detecting means, and the constitution of the cartridge 5 are the same as those in Embodiment 2, thus being omitted from redundant description.

Step S1: The power source circuit is closed by turning on the power source of the image forming apparatus (the power source switch 18-ON or the door switch 16-ON).

Step S2: The control circuit portion 3 judges whether or not the cartridge 5 is mounted on the basis of a signal from a cartridge presence-absence detecting means 31. In the case where the control circuit portion 3 judges that the cartridge 5 is mounted in the apparatus main assembly 1A, the procedure goes to a step S3. The procedure goes to a step S16 and the control circuit portion 3 causes the operating portion 4 to produce warming display, to the effect that the cartridge is not mounted or is improperly mounted, on the display portion while keeping the driving motor in the OFF state in the case where the control circuit portion 3 judges that the cartridge 5 is not mounted (including the case where the cartridge 5 is not properly mounted.

The cartridge presence-absence detection is performed by using the memory 32, so that it is also possible to employ a constitution in which the provision of the means 31 is omitted. That is, the control circuit portion 3 judges that the cartridge 5 is mounted in the case where the control circuit portion 3 is communicatable with the memory 32 on the cartridge 5 side. In the case where the control circuit portion 3 cannot communicate with the memory 32, the control circuit portion 3 judges that the cartridge 5 is not mounted (or that the cartridge 5 is not properly mounted).

Step S3: When the cartridge 5 is mounted, the control circuit portion 3 judges whether or not the mounted cartridge 5 is the fresh cartridge. This judgment is made by reading the information on whether or not the cartridge 5 is the fresh cartridge (the fresh cartridge history information), stored in the cartridge 5-side memory 32 through the transmitting portions 34 and 33.

In the case where the control circuit portion 3 judges that the cartridge 5 is the fresh cartridge, the procedure goes to a step S4. In the case where the control circuit portion 3 judges that the cartridge 5 is not the fresh cartridge, the procedure goes to a step S13.

Step S4: When the control circuit portion 3 judges that the cartridge 5 is the fresh cartridge, the control circuit portion 3 judges whether or not the toner seal 86 is drawn and removed through the remaining toner seal detecting means 130. When the control circuit portion 3 judges that the toner seal 86 is drawn and removed, the procedure goes to a step S5. When the control circuit portion 3 judges that the toner seal 86 is not drawn and removed, the procedure goes to the step S16, in which the control circuit portion 3 causes the operating portion 4 to display, to the effect that the user has forget about drawing and removing the toner seal, on the display portion while keeping the driving motor in the OFF state.

Steps S5 to S12: When the control circuit portion 3 judges that the toner seal 86 is drawn and removed, the control circuit portion 3 turns on the driving motor to start the first initial rotation operation. By the turning-on of the driving motor, the photosensitive drum 6 and the developing roller (developing sleeve) 82 are rotated. The toner stirring member 89 in the developer container 81 rotates in interrelation with the rotation of the developing roller 82 to stir the toner t in the developer container 81 and feeds the toner t in the developer container from the opening 87 to the developing portion 85. That is, the toner is supplied to the developing roller 82. The first initial rotation operation is an operation including the developer supply sequence control (S7 to S9) similarly as in the initial rotation operation described in Embodiment 1. The control circuit portion 3 erases the fresh cartridge history information stored in the memory 32 when the developer supply sequence control is completed (S10).

Then, the control circuit portion 3 ends the initial rotation operation when warming of other required process devices is completed (S11) and stops the drive of the driving motor (S12), thus keeping the image forming apparatus in the stand-by state. The control circuit portion 3 may also execute the image formation on remaining sheets by performing the pre-rotation operation of 4) with no stand-by and then performing the image forming operation of 5) in the case where the image forming job is interrupted.

Steps S13 to S15: The control circuit portion 3 turns on the driving motor to start the second initial rotation operation when the control circuit portion 3 judges that the cartridge 5 is not the fresh cartridge. By the turning-on of the driving motor, the photosensitive drum 6 and the developing roller 82 are rotated. Further, the above-described developer (toner) stirring member is also rotated.

The second initial rotation operation is an operation which does not include the developer supply sequence control (S7 to S9). The control circuit portion 3 applies the charging bias to the charging roller 7 for a time corresponding to the 2-full circumference or more of the drum after the photosensitive drum 6 and the developing sleeve 82 are driven. This charging bias application is made to keep the drum potential at a constant level in order to obtain a proper electrostatic latent image. When warming of other required process devices is completed, the second initial rotation operation is ended (S15) to stop the drive of the driving motor (S12), so that the image forming apparatus is kept in the stand-by state. In the case where the image forming job is interrupted, the control circuit portion 3 performs the pre-rotation operation of 4) described above with no stand-by and the procedure goes to the image forming operation of 5) to carry out the image formation on remaining sheets.

As described above, by providing the remaining toner seal detecting means and making judgment of the start of the initial rotation operation on the basis of the detection result, the initial rotation operation including normal developer supply sequence control is carried out with higher reliability. As a result, it was possible to solve the above-described problems of the cleaning blade.

The remaining toner seal detecting means is not limited to the means using the remaining toner amount detecting means in this embodiment. For example, it is also possible to use such a means that a mechanical switch is provided to the image forming apparatus main assembly and is turned on and off by a grip portion for removing the toner seal 86 to detect the presence and absence of the toner seal 86.

In the above-described image forming apparatuses in Embodiments 1 to 3, the cartridge 5 is only required to be prepared by integrally supporting at least the cleaning blade 91 and the photosensitive drum 6 as the image bearing member and be detachably mountable to the apparatus main assembly 1A of the associated image forming apparatus 1.

The image forming apparatus may also employ an electrostatic recording image forming process. In this case, the image bearing member functions as an electrostatic recording dielectric member. As the information writing means, an electrically discharging means such as an electrically discharging needle array or an electron gun is used to electrically discharge selective a uniformly charged surface of the electrostatic recording dielectric member, thus writing and forming an electrostatic latent image on the surface of the dielectric member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 198573/2008 filed Jul. 31, 2008, which is hereby incorporated by reference.

What is claimed is:

1. An image forming apparatus including a process cartridge which is detachably mountable to a main assembly of said image forming apparatus and includes a rotatable image bearing member, having a surface layer of a lubricant, for bearing an electrostatic latent image and includes a cleaning blade, provided counterdirectionally to a rotational direction of the image bearing member to contact the image bearing member in a predetermined area thereby to form a nip, for removing a developer from the surface of the image bearing member, said image forming apparatus comprising:

charging means for electrically charging the surface of the image bearing member;

developing means for developing, with a developer, an electrostatic latent image formed after the surface of the image bearing member is electrically charged;

fresh cartridge detecting means for detecting whether or not the process cartridge is a fresh cartridge; and control means for effecting control so that when said fresh cartridge detecting means detects that the process cartridge is the fresh cartridge, a developing bias is applied to said developing means in an area of the image bearing member in which a charging bias is not applied to said charging means to deposit developer on the surface of the image bearing member and then the charging bias is applied to said charging means.

2. An apparatus according to claim 1, wherein after an initial rotation operation of said image forming apparatus performed together with rotational drive of the image bearing member at the time when the process cartridge is detected as the fresh cartridge by said fresh cartridge detecting means, a coefficient of kinetic friction at the surface of the image bearing member is 0.5 or more.

3. An apparatus according to claim 1, wherein when the process cartridge is in a fresh state, particles exerting a lubrication action between the cleaning blade and the image bearing member are not applied in the predetermined area in which the cleaning blade contacts the image bearing member.

4. An apparatus according to claim 1, wherein the process cartridge is provided with a storing medium for storing information on whether or not the process cartridge is the fresh cartridge.

5. An apparatus according to claim 1, wherein the process cartridge includes said developing means, and wherein said developing means includes a developer carrying member for supplying developer to the image bearing member, a developer container for containing the developer to be supplied to the image bearing member, and a sealing member which hermetically seals the developer container containing the developer until use of the process cartridge is started so as to separate the developer contained in the developer container from the developer carrying member and which is removed when the use of the process cartridge has been started.

6. An apparatus according to claim 5, further comprising remaining sealing member detecting means for detecting that the process cartridge is mounted to the apparatus main assembly in a state in which said sealing member is not removed, wherein said control means does not effect control for depositing the developer on the image bearing member when a remaining sealing member is detected by said remaining sealing member detecting means.

7. An image forming apparatus including a process cartridge which is detachably mountable to a main assembly of said image forming apparatus and includes a rotatable image bearing member, having a surface layer of a lubricant, for bearing an electrostatic latent image and includes a cleaning blade, provided counterdirectionally to a rotational direction of the image bearing member to contact the image bearing member in a predetermined area thereby to form a nip, for removing a developer from the surface of the image bearing member, said image forming apparatus comprising:

charging means for electrically charging the surface of the image bearing member;

developing means for developing, with a developer, an electrostatic latent image formed after the surface of the image bearing member is electrically charged;

fresh cartridge detecting means for detecting whether or not the process cartridge is a fresh cartridge; and control means for effecting control so that when said fresh cartridge detecting means detects that the process cartridge is the fresh cartridge, an area in which developer is deposited by said developing means in an area of the image bearing member in which the surface of the image bearing member has not been electrically charged reaches the nip by rotation of the image bearing member before reaching, to the nip by the rotation of the image bearing member, of an area of the image bearing member which has opposed said charging means at the time of starting application of the charging bias to said charging means.

8. An apparatus according to claim 7, wherein after an initial rotation operation of said image forming apparatus performed together with rotational drive of the image bearing member at the time when the process cartridge is detected as the fresh cartridge by said fresh cartridge detecting means, a coefficient of kinetic friction at the surface of the image bearing member is 0.5 or more.

9. An apparatus according to claim 7, wherein when the process cartridge is in a fresh state, particles exerting a lubrication action between the cleaning blade and the image bearing member are not applied in the predetermined area in which the cleaning blade contacts the image bearing member.

10. An apparatus according to claim 7, wherein the process cartridge is provided with a storing medium for storing information on whether or not the process cartridge is the fresh cartridge.

11. An apparatus according to claim 7, wherein the process cartridge includes said developing means, and wherein said developing means includes a developer carrying member for supplying developer to the image bearing member, a developer container for containing the developer to be supplied to the image bearing member, and a sealing member which hermetically seals the developer container containing the developer until use of the process cartridge is started so as to separate the developer contained in the developer container from the developer carrying member and which is removed when the use of the process cartridge has been started.

12. An apparatus according to claim 11, further comprising remaining sealing member detecting means for detecting that the process cartridge is mounted to the apparatus main assembly in a state in which said sealing member is not removed, wherein said control means does not effect control for depositing the developer on the image bearing member when a remaining sealing member is detected by said remaining sealing member detecting means.

* * * * *